US011262164B2

(12) United States Patent
Grace

(10) Patent No.: US 11,262,164 B2
(45) Date of Patent: Mar. 1, 2022

(54) POWER ON INDICATOR FOR SIGHT SYSTEM

(71) Applicant: Grace Engineering Corp., Memphis, MI (US)

(72) Inventor: Nathaniel E. Grace, Fort Gratiot, MI (US)

(73) Assignee: Grace Engineering Corp., Memphis, MI (US)

( * ) Notice: Subject to any disclaimer, the term of this patent is extended or adjusted under 35 U.S.C. 154(b) by 0 days.

(21) Appl. No.: 16/749,153

(22) Filed: Jan. 22, 2020

(65) Prior Publication Data

US 2020/0278177 A1 Sep. 3, 2020

Related U.S. Application Data

(60) Provisional application No. 62/806,214, filed on Feb. 15, 2019.

(51) Int. Cl.
*F41G 1/30* (2006.01)

(52) U.S. Cl.
CPC ..... *F41G 1/30* (2013.01)

(58) Field of Classification Search
CPC ..... F41A 1/30
See application file for complete search history.

(56) References Cited

U.S. PATENT DOCUMENTS

| | | | | |
|---|---|---|---|---|
| 5,448,847 | A * | 9/1995 | Teetzel | F41A 17/066 42/70.05 |
| 5,669,174 | A * | 9/1997 | Teetzel | F41A 9/62 356/5.01 |
| 6,252,706 | B1 | 6/2001 | Kaladgew | |
| 6,415,542 | B1 * | 7/2002 | Bates | F41A 17/06 42/70.05 |
| 7,171,776 | B2 | 2/2007 | Staley, III | |
| 8,443,541 | B2 * | 5/2013 | Elpedes | F41G 1/345 42/130 |
| 10,591,249 | B2 * | 3/2020 | Campbell | F41G 1/36 |
| 2003/0101604 | A1 * | 6/2003 | McGivern | F41G 1/467 33/265 |

(Continued)

FOREIGN PATENT DOCUMENTS

| | | | | |
|---|---|---|---|---|
| DE | 10133302 | A1 * | 1/2003 | F41G 1/30 |
| KR | 101086849 | B1 * | 11/2011 | F41G 1/30 |

*Primary Examiner* — Gabriel J. Klein
(74) *Attorney, Agent, or Firm* — Warner Norcross + Judd LLP

(57) ABSTRACT

An aiming device is provided including a body, an optical element joined with the body that has selectively displayed thereon a dot visible to a user along a first line of viewing, and a power indicator distal from the optical element, where the power indicator emits illumination along a second line of viewing, offset from the first line of viewing. The power indicator can alert the user via the illumination that the dot is or is not displayed on the optical element, without the user needing to directly view the dot along the first line of viewing. The illumination emitted by the power indicator can be of a first visible wavelength range, e.g., blue, and the dot can illuminate in a second visible wavelength range different from the first visible wavelength range, e.g., green or red, so the likelihood of confusing the power indicator with the dot can be reduced.

20 Claims, 7 Drawing Sheets

(56) References Cited

U.S. PATENT DOCUMENTS

| | | | | |
|---|---|---|---|---|
| 2004/0025392 | A1* | 2/2004 | Dworzan | F41A 9/53 42/1.01 |
| 2008/0028663 | A1* | 2/2008 | Day | G02B 23/145 42/122 |
| 2011/0138667 | A1* | 6/2011 | Bolden | F41H 13/00 42/1.01 |
| 2014/0096431 | A1* | 4/2014 | Tang | F41G 1/00 42/132 |
| 2015/0198415 | A1* | 7/2015 | Campean | F41G 1/30 42/137 |
| 2015/0267998 | A1* | 9/2015 | Grace, Jr. | F41C 23/16 42/117 |
| 2016/0047626 | A1* | 2/2016 | Kremer | F41G 1/46 42/119 |
| 2020/0158473 | A1* | 5/2020 | Wells | F41G 11/003 |

* cited by examiner

POWER ON INDICATOR FOR SIGHT SYSTEM

BACKGROUND OF THE INVENTION

The present invention relates to aiming devices, and more particularly, to an indicator indicating that an aiming device is powered and ready to aim at a target.

The popularity and use of firearms for hunting, target shooting, and other dynamic shooting sports has increased over the past several decades. The fast-paced, competitive nature of shooting, and the desire by hunters to have well-placed, ethical shots, have led to the development and commercialization of a variety of aiming devices. These devices include red dot sights and reflex sights, to name a few.

Reflex sights typically are used with firearms in a variety of shooting sports and hunting activities where quick target acquisition is favorable. Such sights superimpose a bright illuminated dot against the center of a lens or window within a protective frame or housing. The firearm is aimed by placing the superimposed dot on a target as viewed through the window. Due to the centering of the dot in the window, the window and superimposed dot are both usually centered on the target.

The dot of a reflex sight typically is not visible to a user of a firearm until the firearm is raised to a shooting position perfectly in front of the user. In many shooting activities, it is crucial to ensure that the dot will be visible before the user begins shooting. A user may, out of compulsion to ensure the dot is on and visible, and thus readied for the activity, draw their firearm and partially aim it or otherwise check it to view the dot. While most firearm users will ensure that the firearm is unloaded, this can sometimes present an unsafe condition of the firearm in its drawn state, while the user is checking to ensure the dot is visible and the reflex sight is powered on. Indeed, many competitive and training events prohibit this type of draw and check activity.

Accordingly, some competitive shooters can be seen before an event or activity looking down toward their holstered firearm to double check that their sight is on and the dot is illuminated. While this is usually safe because the firearm is not being handled, it can require the user to shift their holster or its support belt position slightly. Thus, if during this sight check the user accidentally moves their holster from a preferred position, when they later draw the firearm, they might be slowed due to the firearm not being precisely where they usually find it during practice. This can hinder the user's performance in the shooting activity.

Accordingly, there remains room for improvement in the field of aiming devices, particularly with regard to reflex sights to enable a user to confirm their device is powered on and ready to aim.

SUMMARY OF THE INVENTION

An aiming device is provided including a power indicator to visually indicate to a user that the device is on or off and/or a dot of the sight is illuminated without actually viewing the dot.

In one embodiment, the aiming device or sight includes a body that houses electronics and a frame joined with the body. The frame can house an optical element configured to display to a viewer a displayed dot, mark, indicia, sight element and/or reticle pattern (all of which are referred to as a "dot" herein) on the optical element. In some cases, the frame can be in the shape of a closed tube or housing which can provide a level of shade to the optical element so that when the dot is illuminated within the housing, it can be contrasted to a slightly shaded surrounding area within the frame. In other cases, the frame can have an open top, so not much shade is provided.

In another embodiment, the optical element can be housed in the housing so the dot can be viewed by a user along a first line of viewing, where the first line of viewing generally allows the user to view the rear of the sight. The first line of viewing can be parallel to the optical axis of the optical element and/or a longitudinal axis of the housing or body of the sight. The first line of viewing can align with a user's line of sight when the user is aiming the sight at a target by aligning the dot with the target in the user's field of view. The first line of viewing need not be a perfect line, but can include an area that can be viewed at multiple different angles.

In still another embodiment, the sight can include the power indicator. The power indicator can be located on the frame or body, at a location distal from the optical element and the dot. The power indicator can be in the form of an illuminated element, such as a light. The light can be visible on an exterior of the frame and/or the body.

In even another embodiment, the power indicator can be illuminated simultaneously with the dot. For example, when a user turns on the sight such that the dot is illuminated and ready for alignment with a target, the indicator also can become powered on so that the illuminated element is illuminated simultaneously. Thus, a user viewing only the indicator can mentally confirm that when the weapon is raised to aim, the dot will be visible and on as well. Optionally, the dot and indicator can be illuminated at the same instant, or can be illuminated sequentially. After both are illuminated, whether initially at the same time or initially at different times, they can be considered simultaneously illuminated.

In a further embodiment, the illuminated element can be in the form of a light, such as a light emitting diode, or some other type of light. The illuminated element can include a cover. The cover can be generally flush with an exterior surface of the frame and/or the body. The cover can be transparent or translucent. The cover can be colored in some cases. The color can be a color different from a color of the dot so as to prevent inadvertent confusion between the indicator and the dot. The cover can prevent dirt, debris and contaminants from reaching the illuminated element. In some applications, the cover can be opaque and removably disposable over the illuminated element so as to allow the user to selectively conceal or obscure that element.

In still a further embodiment, the illuminated element can be located on a portion of the sight that is distal from or not associated with the rear of the sight, for example, on a side, top, front or bottom of the sight body and/or frame. In this location, the indicator can be obscured when a user is viewing the rear of the sight, and/or the first line of viewing to the dot, such that the user will not confuse the illuminated element of the indicator with the dot. This can avoid a situation where the user effectively aims the sight and associated weapon using the indicator rather than the dot, which would likely result in a missed target or other undesirable outcome.

In yet a further embodiment, the indicator can be situated relative to the frame and/or body such that the indicator is visible from a second line of viewing that is different from the first line of viewing. Thus, a user viewing the first line of viewing to view the dot will not view the dot and indicator simultaneously. The user viewing the first line of viewing will not be able to view the second line of viewing and will not see the illuminating element.

In even a further embodiment, the first line of viewing and second line of viewing are offset from one another by a predetermined angle. The first line of viewing and the dot is visible to the user when the sight is in a first orientation relative to the user, while the second line of viewing and the indicator is visible to the user when the sight is in a second orientation relative to the user. For example, when the sight is in an orientation such that the rear of the sight is viewable by the user, the first line of viewing is also viewable, but the second line of viewing is not. Thus, the dot is viewable but the indicator is not viewable by that user. When the sight is in an orientation that the top of the sight is viewable by the user, the second line of viewing is viewable but the first line of viewing is not. Thus, the indicator is viewable but the dot is not.

In another, further embodiment, the indicator can be inset in a recess defined by at least one of the body and the frame. The recess can be configured with a recess longitudinal axis that is angled or offset relative to the first line of viewing. Thus, the illuminated element, when illuminated, is not visible to the user when the user is viewing the dot.

In still another, further embodiment, the indicator can be in a recess that is a bore defined in a top or side of the frame or body. The bore can be of a depth sufficient so that the frame or housing walls around the bore obscure the indicator from a user viewing the dot from the rear of the sight.

In yet another, further embodiment, the sight can include a level sensor such that the indicator is illuminated when a longitudinal axis of the body is in a first orientation relative to a horizontal plane, and such that the indicator is not illuminated when that axis is in a second orientation relative to the horizontal plane.

The current embodiments of the aiming device provide benefits in shooting sports and hunting that previously have been unachievable. For example, where the sight includes a power indicator, a user can check that power indicator and can be confident that the dot of the sight will be on and illuminated when the user draws and aims a weapon with the sight. Thus, a user need not draw their weapon to check the power and see if the dot is actually illuminated. This can reduce dangerous situations where a weapon is un-holstered, particularly at competitive shooting events. Military, law enforcement or other personnel can also be certain that their sight is illuminated before engaging in a potentially dangerous activity, such as combat or a gunfight with an adversary, without ever drawing their weapon and looking into the sight. Where the sight includes a closure to conceal the illuminated element of the indicator, a user can utilize this feature in situations where they do not want others to know their location, particularly in low light environments, where the indicator may give up the user's location, thereby putting them in danger. Where the sight includes the level sensor, that sensor and electronics of the sight can illuminate the indicator so a user can confirm the dot is illuminated while the associated weapon is in a holster, in a generally vertical orientation. The same can turn off the indicator when the weapon is drawn to another orientation, such as generally horizontal, and the indicator is no longer needed because the user is viewing and aiming the weapon via the dot.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

A current embodiment of the aiming system, also referred to as a sight herein, is illustrated in FIGS. 1-6 and generally designated 10. To begin, the sight 10 is shown mounted on a semi-automatic pistol. The sight 10 can, however, be mounted on other types of projectile shooting devices. For example, it can be mounted to other types of firearms, including but not limited to a rifle (for example, a long rifle, a carbine, an assault rifle, a bolt pump rifle or a battle rifle); a shotgun (of any gauge) and/or a machine gun (for example, a machine pistol, a light machine gun, a mini gun, a medium machine gun or a heavy machine gun). The firearm can include any type of action, for example, bolt action, lever action, pump action and/or break action. The firearm can be single shot, automatic and/or semiautomatic. Further optionally, the firearm can be in the form of a vehicle-mounted weapon, mounted directly to the vehicle, a watercraft or other mode of transportation of course. As used herein, firearm can also include cannons, howitzers, handheld rocket launchers and similar weaponry, as well as equipment such as paint ball markers and air rifles such as bb guns, air soft guns and/or pellet guns. The projectile shooting device alternatively can be in the form of an archery bow, including but not limited to a compound bow, a recurve bow, a crossbow, or other device from which arrows or bolts can be shot.

Figure 1:
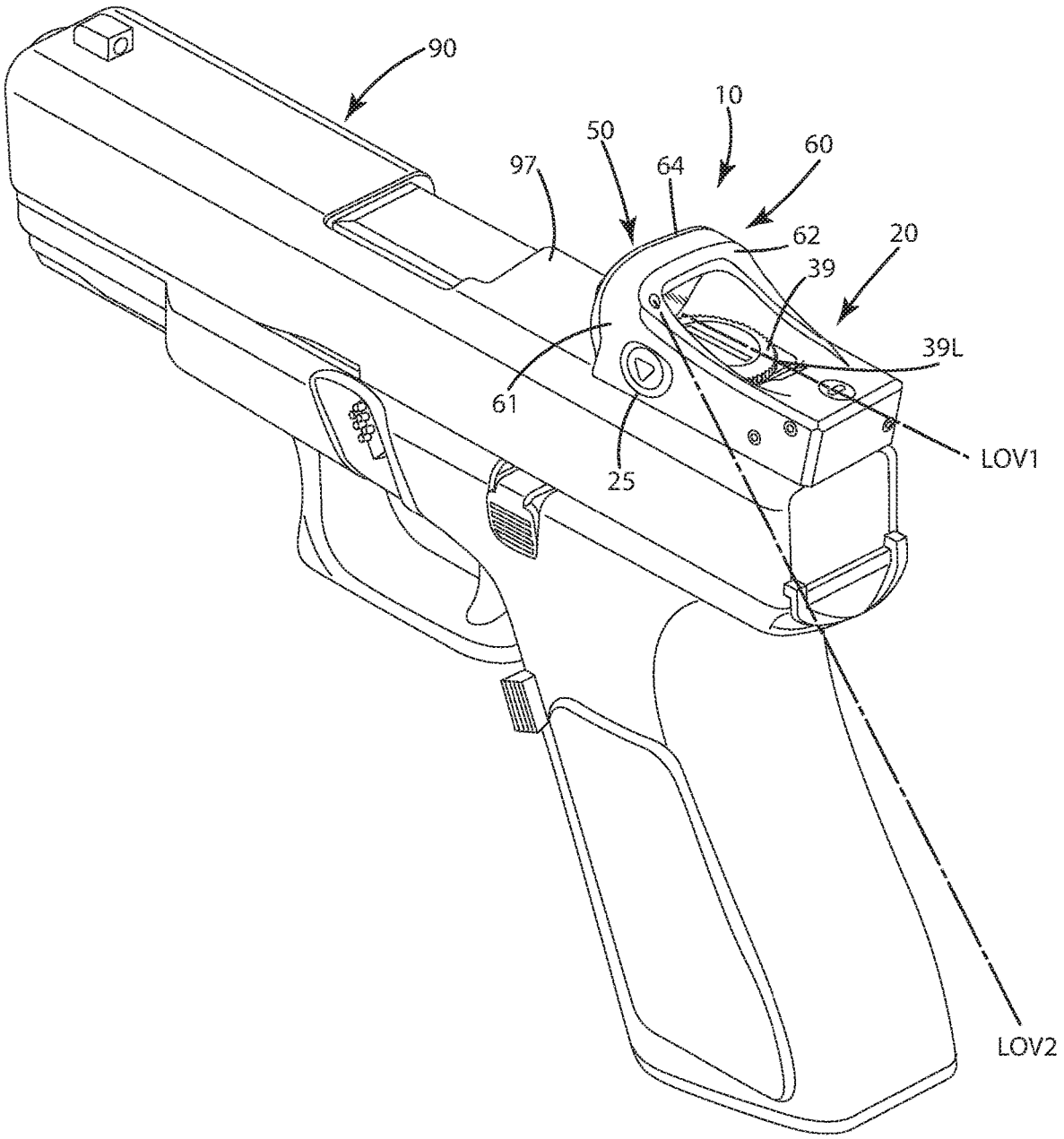
FIG. 1 is a rear perspective view of the aiming device of a current embodiment mounted on a firearm.

Returning to the sight 10 mounted on the firearm in FIG. 1, the sight can be mounted atop a slide 97 of the pistol 90, generally to the rear of the slide, over a grip of the pistol. The sight 10 can be mounted in the same location where a mechanical rear sight was once located.

The sight 10 can include a body 20 that functions as a housing for electronics, an illumination device 30 and a power source 39, such as a battery, capacitor or other electricity storing or generating element. The body 20 includes an upwardly extending protective frame 60 joined with the body and optionally forming a portion thereof. An optical element 50, optionally in the form of a non-magnifying lens can be mounted in a generally upright position in the protective frame, thereby providing a viewing window for a target T in a field of view. Light, illumination and/or a holographic image is emitted from an illumination device 30, which in some cases can be in the form of a miniature light emitting diode (LED), positioned at a focal point rearward of optical element 50 and within the body 20.

The illumination device 30 can be operable to selectively display a dot 59 (FIGS. 4, 5) on the optical element 50 that is visible to a user within a field of view of the user. In this regard, the light from the illumination device 30 optionally can be reflected rearward toward the user's eye by a dichroic reflection layer or coating of the optical element, which can be a lens 50, as collimated light, so that the user perceives the reflected light as the dot is superimposed on the field of view at infinite distance by electronics housed in the body.

Although shown as a circular shaped dot, the dot 59 can come in variety of shapes, sizes and configurations. As used herein, the term dot can refer to any dot, mark, image indicia and/or reticle pattern used to sight the aiming device on a target. The term dot also can refer to holographic images that are used to sight the aiming device on a target, whether or not disposed or displayed on the optical element, or in front of it or behind it.

The power source 39 can be disposed in a battery compartment defined by the body 20. The power source 39 can be a button cell battery that powers electronics 38 that drive the illumination device 30. The battery can be accessed via a threaded lid 39L that covers a threaded opening to the compartment located in body 20 between optical element 50 and the illumination device 30. The lid 39L can be recessed below the illumination device 30 to provide a clear optical path for illumination generated by it to reach lens 50. A small slot or notch is provided in a top of lid to assist in grasping it with a user's fingernail for toolless opening, or with the rim of a cartridge, a coin or tool. When closed, the lid 39L can be sealed to body 20 via an O-ring (not shown) that is compressed between lid and a tapered surface bordering the opening to the compartment.

Figure 3:
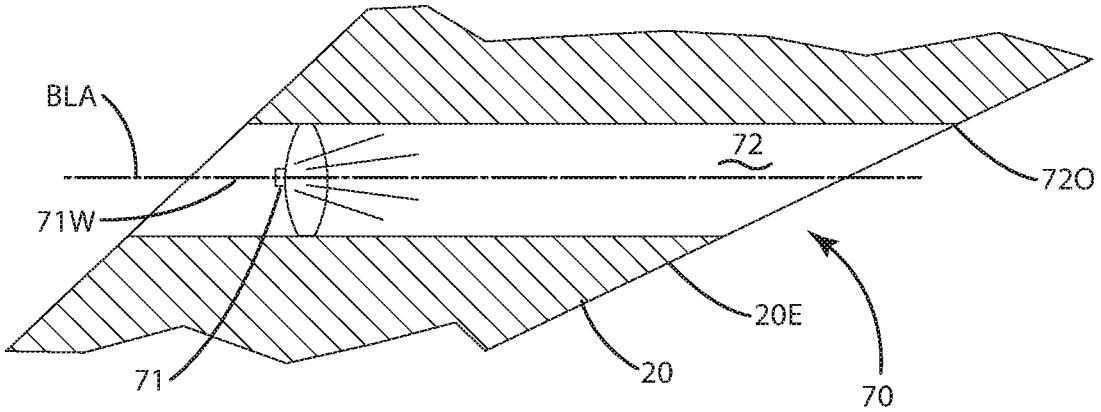
FIG. 3 is section view of the power indicator of the aiming device.
Figure 4:
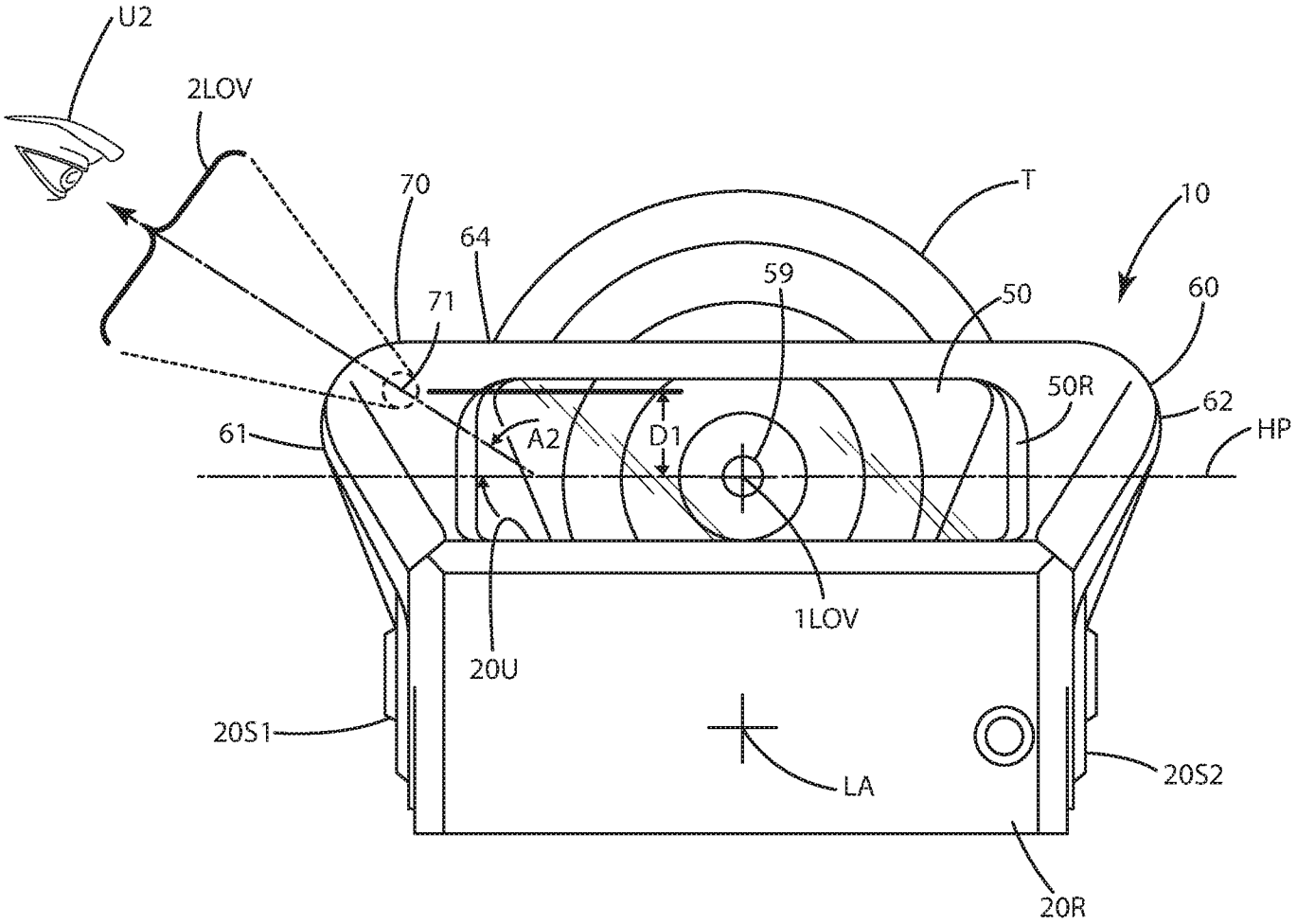
FIG. 4 is a rear view of the aiming device from a user's point of view while acquiring a target, with the red dot visible along a first line of viewing by a user viewing the rear of the sight, but the power indicator not visible to the user along the second line of viewing.

With reference to FIGS. 3-4, the body 20 can include a set switch 25 including a selector button 26 formed of an elastomeric or flexible plastic material that is manually depressible to actuate switch 25 and thereby control a setting of sight 10. The selector button 26 may allow a user to control a setting of the sight, such as an illumination mode, illumination brightness, reticle pattern, other attribute of illuminated aiming mark 59, or an on/off function of the sight 10. Generally the selector button can be in electrical communication with the electronics 38 of the sight, which can include a circuit, a processor or other elements that are further in communication with the illumination device 30 and/or the power source 39. Again, the selector switch 25 provides signal input to the electronics and enables a user to cycle through various illumination settings of sight 10. Optionally, the selector button 26 can be depressed to toggle between an automatic mode and one or more manual modes for an illumination setting of aiming mark 59. In an automatic mode, a photo sensor or other light sensor (not shown) of sight 10 can measure ambient light and a brightness control circuit may automatically determine and set an appropriate illumination intensity of the dot or aiming mark 59 based on the measured ambient light. In a manual mode, the user can cycle through various illumination settings by manually depressing selector button until a suitable light intensity level is obtained. Further optionally, a user can depress the selector button to cycle through several settings in sequence, including: on, high, medium or low intensity, and/or off.

With reference to FIGS. 1-6, the sight includes the optical element 50 noted above. This optical element 50 can be joined with the body 20 via a protective frame 60, which can form a part of the body. The protective frame 60 can be integrally formed with the body or a housing of the body. In many cases, the protective frame can be aesthetically integrated into and can form an extension of the body and its components. The frame itself and/or the body can be constructed from a variety of materials, such as polymers, composites, metals and combinations thereof. Optionally, the optical element, frame and body can form an aiming device such as that disclosed in copending U.S. Patent Application Publication 2019/0360777 to Grace, et al, first filed on May 23, 2018, which is hereby incorporated by reference in its entirety.

As shown in FIGS. 3 and 4, the protective frame 60 can include a base 63, a first upright arm 61, a second upright arm 62 and a roof 64. The base, first arm, second arm and roof 64 can cooperatively form a viewing recess 69 within which the optical element 50 is at least partially disposed. The base 63 can extend laterally from a left side to a right side of the sight 10, generally crossing the longitudinal axis LA of the base and the aiming device in general. This longitudinal axis LA can generally bisect the sight 10 into corresponding left and right sides.

Figure 5:
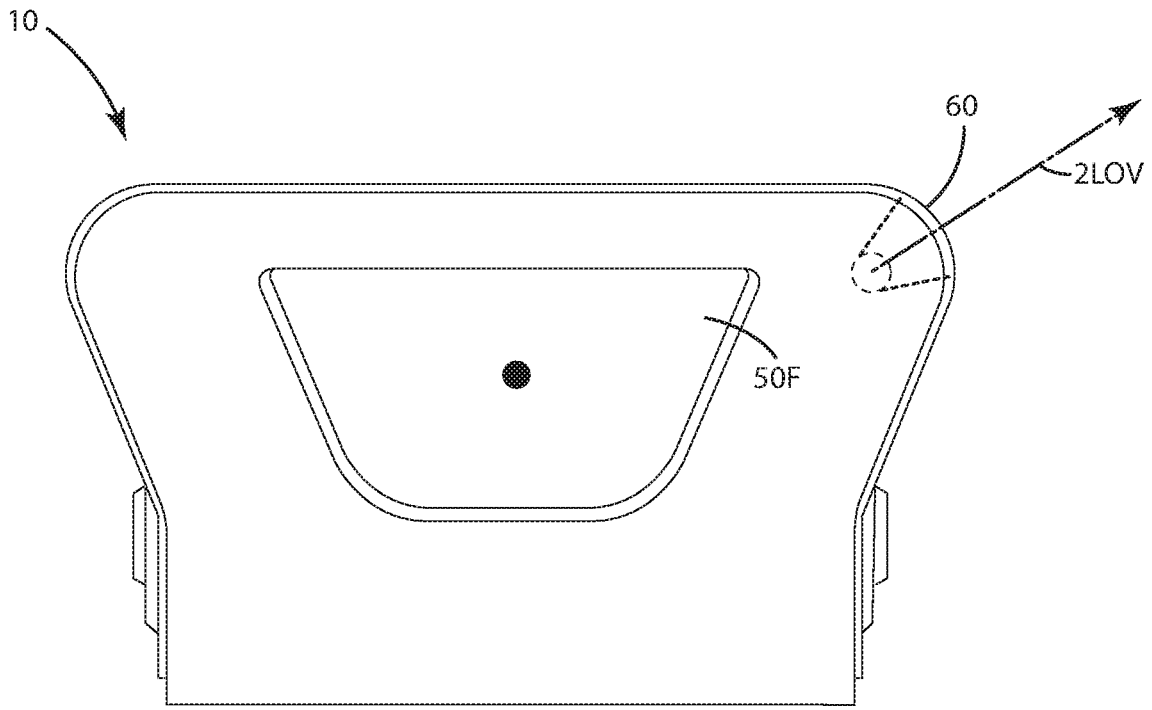
FIG. 5 is front view of the aiming device.

As shown in FIGS. 4 and 5 the optical element 50 is disposed in the viewing opening 69 defined in the frame. Faces of the optical element include the front surface 50F and the rear surface 50R. The rear surface 50R is faced toward a user when using the sight, while the front surface 50F faces away from the user using the sight. The optical element can be constructed from glass, polymer, polycarbonate, crystal, or other light transmissive or transparent materials. Some non-limiting examples of lenses can include TRIVEX lenses, commercially available from PPG Industries of Pittsburgh, Pa., as well as a nanolayered gradient refractive index (GRIN) lenses, commercially available from Peak Nano of Coppell, Tex. Optionally, lens material can be doped with or otherwise include thermal chromic, photochromic or other light adaptive materials. In this manner, the optical element can function like photochromic lenses, thermochromic lenses or other light adaptive lenses. When including a photochromic material or compound, the optical element, when activated by ultraviolet rays from the sun, can darken. When ultraviolet rays are not present, the optical element can be less darkened or more clear.

Figure 6:
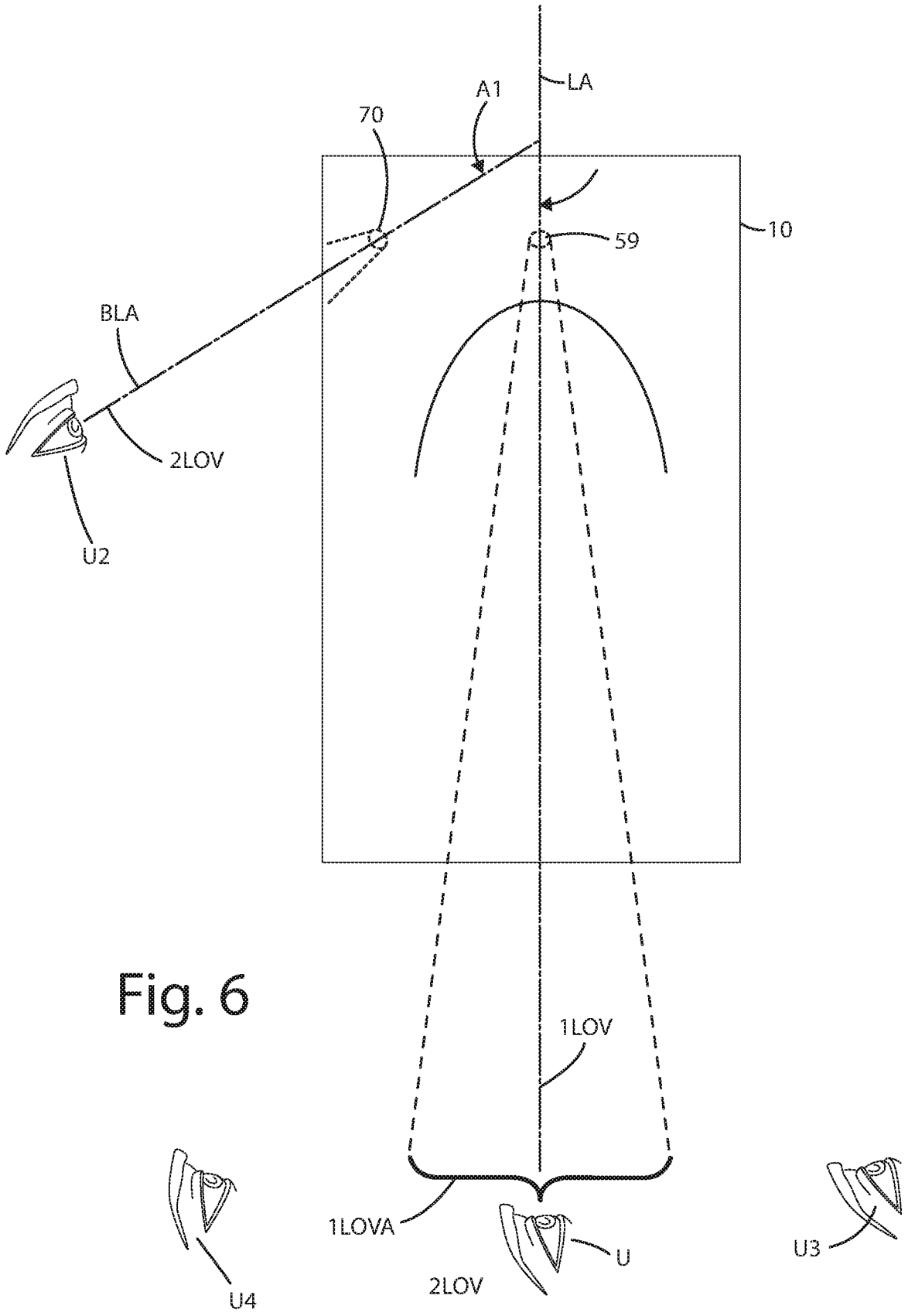
FIG. 6 is a top view of the aiming device.

As mentioned above and shown in FIGS. 4 and 6, the dot 59 can be displayed on the optical element 50. The dot 59 can be in a field of view of a user viewing the sight 2 from the rear 20R of the body, that is, with the user looking toward the rear of the body. When the dot is viewable on the optical element, the optical element has selectively displayed thereon the dot that is visible to the user U. The dot itself is visible along a first line of viewing 1LOV. This line of viewing can be a line or area that when viewed by the user enables the user to see the dot 59. For example, as shown in FIG. 6, the line of viewing 1LOV can also include the area 1LOVA within which a user U can move their eye or eyes and yet still be able to view the dot 59 in or on the optical element 50. This area can be a horizontal area as shown in FIG. 6 and/or a vertical area similar to that horizontal area in dimension, except extending vertically out of the page and into the page of FIG. 6. Of course, the area of the first line of viewing 1LOV can change depending on the orientation, shape and size of the dot and the optical element.

As shown in FIG. 6, the first line of viewing 1LOV can be generally parallel to the longitudinal axis LA of the body. Optionally the first line of viewing 1LOV can lay above the longitudinal axis LA of the body, as shown in FIG. 4. The first line of viewing 1LOV also can lay generally within a horizontal plane HP as shown in FIG. 4. That horizontal plane optionally can separate the optical element 50 into upper and lower portions of same or different dimensions.

As mentioned above, the dot 59 can become obscured or not visible outside the first line of viewing 1LOV and optionally its associated area 1LOVA. For example, when the user moves their eyes to positions U3 and U4 as shown in FIG. 6, the user can no longer see the dot 59. Of course, there can be many other positions where the user cannot see the dot 59, such as when viewing the sight 10 from a top plan view as shown in FIG. 6, or when a user U views the sight 10 from the view shown in FIG. 7. There, the aiming device 10 is mounted to the firearm 90 which is in a holster 92 on a user's belt 93. This is a common position for a user to carry the firearm on which the sight 10 is mounted. In this position, the firearm and sight are oriented generally vertically, with the longitudinal axis LA a generally vertical orientation. As such, the line of viewing 1LOV is obscured by a portion of the frame 60. Thus, the dot 59 cannot be viewed by the user. In this case, the user cannot visually confirm that the dot itself is illuminated or otherwise directing illumination back toward the user.

Accordingly, the aiming device 10 of the current embodiments includes a power indicator 70 that emits illumination along a second line of viewing 2LOV that is offset, optionally, at the same angle from the first line of viewing 1LOV. With this power indicator, a user visually can confirm that the dot 59 is displayed and/or the aiming device is powered on such that the dot is displayed on the optical element or the aiming device and/or otherwise functioning and operable for use of the aiming device in a predetermined manner—without the user actually viewing the dot on the optical element along the first line of viewing 1LOV. Using the example shown in FIG. 7, the user U can view the power indicator 70 along the second line of viewing 2LOV without viewing the first line of viewing and/or the associated dot 59 that is within that first line of viewing 1LOV. Thus, the user can maintain their eyes outside the first line of viewing 1LOV (FIG. 6) without directly viewing the dot 59, and the user can be assured that the dot will be displayed on the optical element when the aiming device 10 is oriented later, as shown for example in FIG. 4, such that the dot is visible to the user along the first line of viewing 1LOV.

As mentioned above, the second line of viewing 2LOV can be offset relative to the first line of viewing 1LOV. For example, the second line of viewing can be angularly offset relative to the first line of viewing as shown in the top view of the aiming device in FIG. 6. There, the first line of viewing is angularly offset by an angle A1 relative to the second line of viewing. This angle A1 can be optionally between 0° and 180°, between 1° and 179° inclusive, between 5° and 90° inclusive, between 5° and 85° inclusive, between 10° and 80° inclusive, between 15° and 75° inclusive, between 30° and 60° inclusive, or about 45°. Of course, depending on where the power indicator 70 is located, this angle A1 can vary significantly. For example, in the alternative embodiment of FIG. 8, the second line of viewing 2LOV can be disposed generally perpendicular to the first line of viewing 1LOV as described below.

With reference to FIG. 4, the second line of viewing 2LOV also can be angularly offset relative to the first line of viewing 1LOV in another orientation. For example, the second line of viewing can be offset at an angle A2, which can be equal to any of the optional angles referenced above in connection with angle A1. As shown, this angle A2 and the second line of viewing, however extends upwardly relative to the horizontal plane HP. In some cases, the second line of viewing can be transverse to the horizontal plane and transverse to the first line of viewing. The degree by which the second line of viewing is transverse to these other elements can correspond to the angles mentioned herein and others, depending on the application. The second line of viewing 2LOV also can originate at an illumination element 71 of the power indicator 70. Thus, the second line of viewing 2LOV can originate and can be vertically displaced a distance D1 above or below the horizontal plane HP and/or the dot 59. This distance D1 can be optionally 1 mm, 2 mm, 3 mm, 4 mm, 5 mm, 10 mm, 15 mm, 20 mm, 25 mm, 30 mm, 35 mm, 40 mm or 50 mm or other distances depending on the application and the orientation of the power indicator relative to the dot on the optical element.

Figure 2:
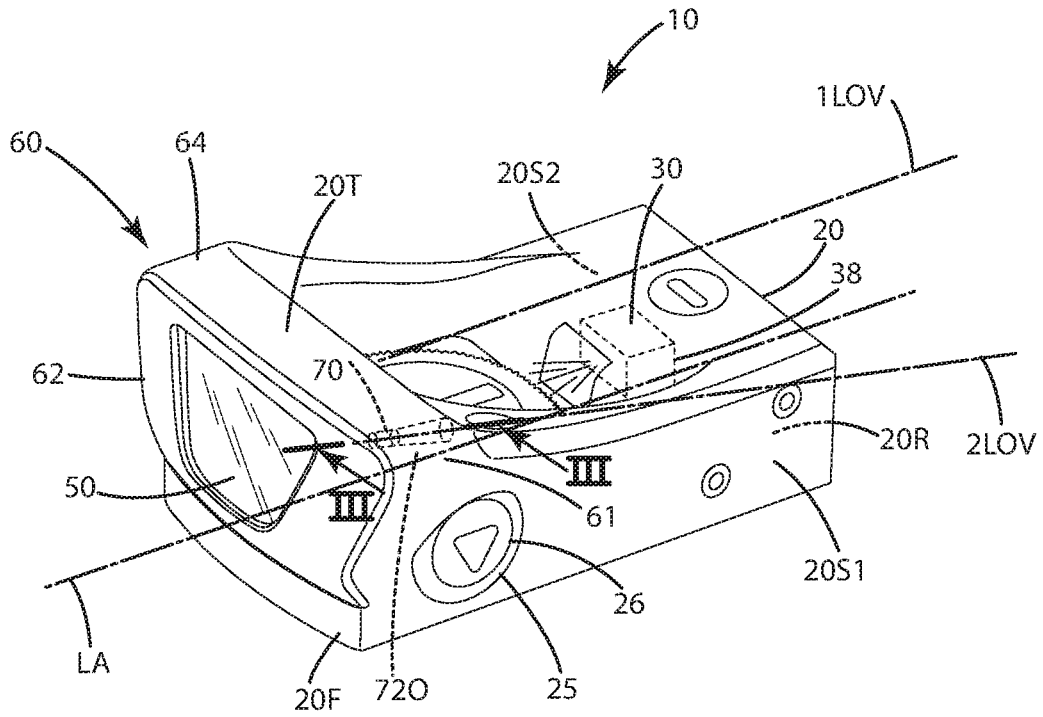
FIG. 2 is a front perspective view of the aiming device, with a red dot on an optical element of the sight is viewable along a first line of viewing, while a power indicator is illuminated and projecting illumination along a second line of viewing to indicate that the dot is illuminated.

The power indicator 70 of the current embodiments can come in a variety of configurations and include various components. One configuration is shown in FIGS. 2 and 3. There, the power indicator 70 can be associated with a side 20S1 of the body 20. Optionally, the side 20S1 can be associated with an arm 61 of the frame 60. The power indicator can be located at the transition between the roof 64 and the arm 61, generally on the side 20S1 and perhaps partially on the top 20T of the body 20. In other applications, the power indicator 70 can be located on the top 20T of the body, the opposite side 20S2, the front 20F and/or the rear 20R of the body. In other applications, multiple power indicators can be disposed on different portions of the sight 10.

Figure 8:
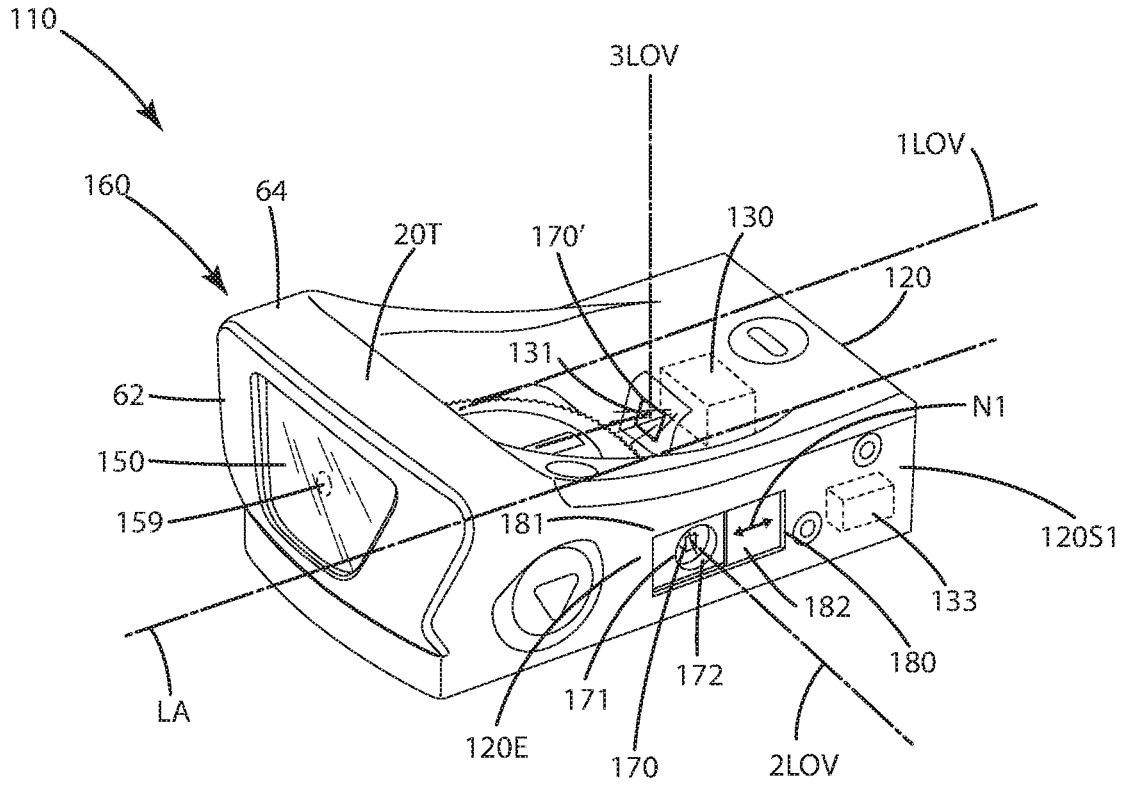
FIG. 8 is a first alternative embodiment of the aiming device, with a power indicator on a side of the body of the aiming device and a closure movable over the indicator to selectively conceal the illumination therefrom.

For example, as shown in the alternative embodiment of FIG. 8, a first power indicator 170 can be disposed on a first side 20S1 of the sight body 120 to project a second line of viewing 2LOV from that side. As mentioned above, the second line of viewing can be perpendicular to the first line of viewing. As also shown in FIG. 8, the light source or illumination source 130 that is used to generate the dot on the optical element 150 can include a diffuser, reflector, fiber optic or special lens 131 that projects illumination upward from the body 120 along a third line of viewing 3LOV. With this third line of viewing 3LOV and second power indicator 170', the sight can include two power indicators, so that a user can confirm that the dot 59 is displayed on the optical element 150 from multiple viewing perspectives of the body 120 as described in further detail below. As will be appreciated, in this embodiment, either the first or the second power indicators also can be used individually, without the other.

As shown in FIG. 13, the power indicator 70 can include an illumination element 71 as mentioned above. This illumination element 71 can be in the form of an LED, and/or any of the other light sources mentioned above in connection with the illumination source 30. The illumination element 71 can be in electrical communication with the electronics and/or the power source 39 of the sight via a wire 71W or other connection.

The illumination element 71 can be disposed in a recess 72. This recess optionally can be a form of a bore or aperture that extends inwardly from the exterior surface 20 of the body 20. The recess itself can extend below that exterior surface 20 the body and/or the frame. In this manner, the user cannot directly view or see the illumination element 71 when the user is viewing the sight and the body along a line or plane parallel to that exterior surface 20. The illumination element 71 can be partially hidden and/or concealed within the body and/or frame. Being inside the recess, the illumination element also is less likely to be engaged by an object or the user to potentially damage it. The bore can extend optionally at least 1 mm, at least 2 mm, at least 3 mm, at least 4 mm, at least 5 mm, at least 10 mm, at least 15 mm, at least 25 mm, between 0.1 mm and 5.0 mm, inclusive, or between 1 mm and 8 mm inclusive below the exterior surface, with the illumination element optionally not extending beyond the opening 72O of the recess or bore 72.

The recess or bore, both referred to interchangeably, can include a bore longitudinal axis BLA, which is shown in FIGS. 3 and 6. Where the bore 72 is of a cylindrical shape, and the bore 72 is angled relative to the exterior surface 20E, the opening 72O of the bore can be elliptical and/or parabolic. Of course, where the bore is polygonal or some other shape, the opening can be correspondingly shaped. The bore longitudinal axis BLA can be aligned with and/or parallel to the second line of viewing 2LOV. Accordingly, this axis also can have same angular and spatial relationships relative to the first line of viewing 1LOV as the second line of viewing 2LOV, as mentioned above.

The aiming device 10 can be set up with the power indicator so that a user using the device 10 while aiming does not inadvertently confuse the power indicator for the dot 59 or vice versa. Although shown with the power indicator 70 located on the sides, top and/or front of the body, in some applications, the power indicator and the illumination element can be set up to be viewable from the rear 20R of the body. In this case, the first line of viewing and second line of viewing can project from the rear 20R of the body. A user viewing the dot along the first line of viewing also can see the illumination element of the power indicator along the second line of viewing. In this case however, it can be helpful to ensure that the power indicator and the dot are visibly distinct or generally different from one another in appearance to reduce the likelihood of confusion.

Optionally, the power indicator can emit a first illumination therefrom with the illumination element. The illumination element can emit illumination that is within a first visible wavelength range. The wavelength range can correspond to a color or range of colors. As an example, the first wavelength range optionally can be between 490 nm-450 nm inclusive, which generally corresponds to the color blue. The dot, on the other hand, can be displayed in a second, different wavelength range. As an example, the second wavelength range optionally can be between 560 nm-520 nm inclusive, 590 nm-560 nm, inclusive or 700 nm-635 nm, inclusive, which can correspond to the colors green, yellow and red respectively. Generally, the illumination emitted by the power indicator can be a different color than that of the dot. In other applications, the intensity of illumination of the power indicator in the dot can be different.

A first alternative embodiment of the aiming device is shown in FIG. 8 and generally designated 110. This embodiment is similar to the embodiment described above in structure, function and operation with several exceptions. For example, this aiming device 110 includes a body 120 having a frame 160 that is disposed at least partially around an optical element 150. A dot 159 is displayed on the optical element 150 via illumination from an illumination source 130. The illumination emitted by the illumination source 130 to project the dot 159 on the optical element 150 serves another function. In particular, one power indicator 170' in this embodiment is powered by the illumination source 130 that also projects the dot 159. For example, the power indicator 170' can include a reflector, diffuser, fiber-optic or other light redirecting element 131 that captures and redirects a portion of the illumination from the illumination source 130. This in turn emits illumination along a third line of viewing 3LOV (sometimes considered a second line of viewing). This second or third line of viewing 3LOV is transverse to the first line of viewing 1LOV. As shown, it is generally perpendicular to the first line of viewing, but may be disposed at other angles depending on the particular configuration of the power indicator 170'. With this construction, the aiming device 110 need not have a separate illumination element in a power indicator (although as shown it does).

This alternative embodiment also can include another power indicator 170. This power indicator 170 can be disposed in a side 120S1 of the body 120. It can also emit illumination along a second line of viewing 2LOV, which is offset or transverse to the first line of viewing 1LOV as described above, as well as the third line of viewing 3LOV. In this embodiment, the illumination element 171 can lay in a shallow recess 172. Optionally, although not shown, the illumination element in some cases can project slightly outward from the exterior surface 120E of the body 120.

In this embodiment, the aiming device 110 also can include a closure 180. The closure can be movably joined with the body and/or the frame. The closure can be selectively disposable over the illumination element 171 of the power indicator 170. Generally, the closure can include a door 182 that is slidable in tracks 181. The door 182 can be slidable in directions N1, generally to conceal and protect or cover the illumination element when the illumination element emits illumination. This closure can be used to conceal the illumination element in, while the dot 159 is visible to a user along the first line of viewing 1LOV. With this feature, a user can effectively conceal the illumination emitted by the power indicator 170 in special situations. For example, the aiming device may be used in a particular activity in low light, where concealment of the power indicator prevents third parties from seeing the illumination and thus determining the location of the user. Although shown with a sliding door, the closure can include a door that hingably closes over the power indicator or a plug that plugs into the recess or otherwise can be secured or placed over the illumination element.

The aiming device 110 of the alternative embodiment or the device 10 of the current embodiment can include a position sensor 133 housed in the body or otherwise associated with the electronics of the device. This position sensor can be configured to detect when the body 20 is in a generally horizontal orientation and/or a generally vertical orientation. In response to the sensor detecting the body is in a particular orientation, the electronics and the device can illuminate or not illuminate the illumination element of the power indicator to conserve battery life. For example, the power indicator can be illuminated in response to the sensor detecting the body 20 is in the generally vertical orientation. The power indicator is not illuminated in response to the sensor detecting the body is in the generally horizontal orientation. Of course, the precise orientations can be calibrated depending on the particular application.

Figure 7:
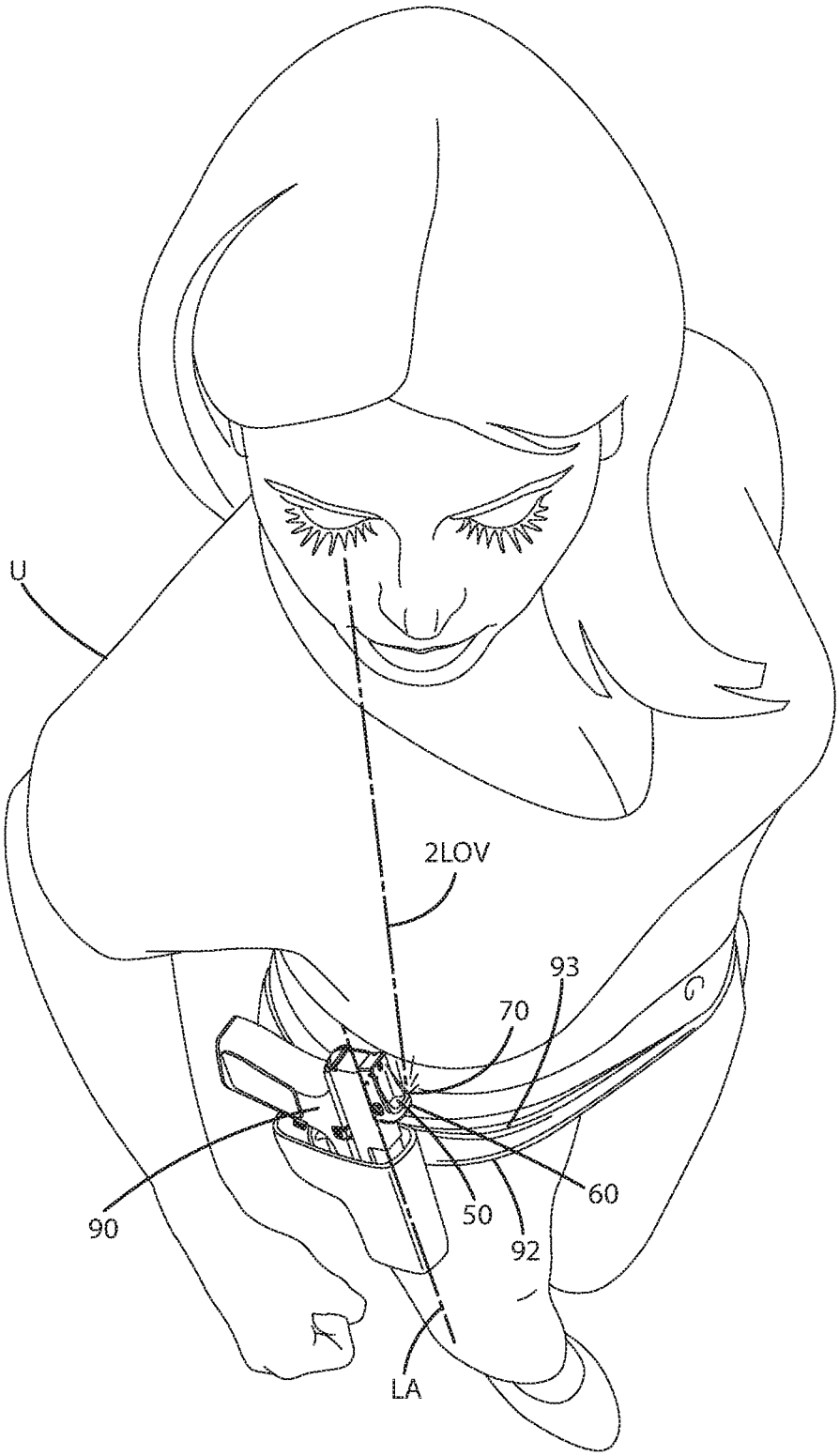
FIG. 7 is a perspective view of a user looking vertically down at a holstered firearm with the aiming device to view the power indicator along a second line of viewing, with a dot on an optical element not visible from that perspective to the user.

With the calibration mentioned above, when aiming device is on a firearm 90 that is holstered, similar to that shown in FIG. 7, the position sensor can detect that the body is in a generally vertical orientation which can correspond to a holstered condition. In this case, the user likely cannot see the dot along the first line of viewing. Accordingly, the power indicator can be illuminated to confirm for the user that the device is powered and the dot is illuminated along the second line of viewing. When the user draws the firearm 90 and the body attains a generally horizontal orientation, the power indicator can be turned off with the illumination not illuminated in response the sensor detecting that orientation. In the generally horizontal orientation, the user likely is aiming the sight and has full view of the dot along the first line of viewing. Accordingly, the power indicator need not be on and can be off to conserve battery life.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The invention claimed is:

1. A reflex sight aiming device comprising:

a body having a front, a rear and opposing sides, the rear configured to face toward a user during use of the aiming device to aim at a target, the body including a longitudinal axis;

an illumination device housed in the body;

a power source in electrical communication with the illumination device;

a protective frame joined with the body;

an optical element joined with the protective frame such that the protective frame extends at least partially around the optical element; and a power indicator located distal from the optical element, the power indicator in electrical communication with the power source, the power indicator joined with at least one of the body and the protective frame, wherein the illumination device is operable to display a dot on the optical element that is visible to a user along a first line of viewing within a first field of view from the rear of the body, wherein the power indicator is operable to emit illumination along a second line of viewing that is offset from the first line of viewing such that the user cannot view the emitted illumination from the power indicator while the user is viewing the dot along the first line of viewing from the rear of the body and aligning the dot with a target distal from the aiming device wherein the second line of viewing is out of the first field of view so that the emitted illumination along the second line of view is not viewable within the first field of view when the user is viewing the dot along the first line of viewing, wherein the power indicator is disposed on the frame above the dot on the optical element that is visible to the user along the first line of viewing within the first field of view from the rear of the body of the reflex sight aiming device, wherein the power indicator is disposed in a bore having a bore longitudinal axis that is offset at an angle between 1° and 89°, inclusive, from the longitudinal axis of the body.

2. The reflex sight aiming device of claim 1, wherein the power indicator includes an illumination element that emits a first illumination therefrom, the first illumination being in a first visible wavelength range, wherein the dot is displayed on the optical element in a second visible wavelength range different from the first visible wavelength range.

3. The reflex sight aiming device of claim 2, wherein the power indicator includes a recess defined in at least one of the body and the frame, wherein the illumination element is disposed in the recess, below an exterior surface of the at least one of the body and the frame, whereby the user cannot see the illumination element when the user is viewing along a line parallel to the exterior surface and within the first field of view.

4. The reflex sight aiming device of claim 1, wherein the power indicator includes a recess defined in at least one of the body and the frame, wherein an illumination element is disposed in the recess, below an exterior surface of the at least one of the body and the frame, whereby the user cannot see the illumination element when the user is viewing the dot along the first line of viewing.

5. The reflex sight aiming device of claim 1, comprising:

a closure movably joined with at least one of the body and the frame, the closure being selectively disposable over an illumination element of the power indicator, wherein the closure can be placed over the illumination element to conceal the illumination element while the illumination element emits illumination, wherein the dot is visible to the user along the first line of viewing while the closure conceals the illumination element from the user viewing the dot along the first line of viewing.

6. The reflex sight aiming device of claim 1, wherein the dot is not visible to the user when the user is viewing illumination from the power indicator from the second line of viewing, wherein the dot is obscured by at least one of the body and the frame when the user is viewing illumination from the power indicator from the second line of viewing.

7. An aiming device comprising:

a body having a front, a rear and opposing sides, the rear configured to face toward a user during use of the aiming device to aim at a target;

an illumination device housed in the body;

a power source in electrical communication with the illumination device;

a protective frame joined with the body;

an optical element joined with the protective frame such that the protective frame extends at least partially around the optical element; and a power indicator located distal from the optical element, the power indicator in electrical communication with the power source, the power indicator joined with at least one of the body and the protective frame, wherein the illumination device is operable to display a dot on the optical element that is visible to a user along a first line of viewing from the rear of the body, wherein the power indicator is operable to emit illumination along a second line of viewing that is offset from the first line of viewing such that the user cannot view the emitted illumination from the power indicator while the user is viewing the dot along the first line of viewing from the rear of the body and aligning the dot with a target distal from the aiming device, wherein the power indicator is disposed in a bore that includes a bore longitudinal axis, wherein the bore longitudinal axis is offset at an angle between 5° and 85° inclusive, relative to a longitudinal axis of the body when viewed from a top view of the aiming device.

8. The aiming device of claim 7, wherein the bore extends at least 1 mm below the exterior surface, wherein the power indicator is adjacent at least one of a right side and a left side of the body, distal from the rear of the body.

9. An aiming device comprising:

a body having a front, a rear and opposing sides, the rear configured to face toward a user during use of the aiming device to aim at a target;

an illumination device housed in the body;

a power source in electrical communication with the illumination device;

a protective frame joined with the body;

an optical element joined with the protective frame such that the protective frame extends at least partially around the optical element;

a power indicator located distal from the optical element, the power indicator in electrical communication with the power source, the power indicator joined with at least one of the body and the protective frame; and a position sensor configured to detect when the body is in at least one of a generally horizontal orientation and a generally vertical orientation, wherein the illumination device is operable to display a dot on the optical element that is visible to a user along a first line of viewing from the rear of the body, wherein the power indicator is operable to emit illumination along a second line of viewing that is offset from the first line of viewing such that the user cannot view the emitted illumination from the power indicator while the user is viewing the dot along the first line of viewing from the rear of the body and aligning the dot with a target distal from the aiming device, wherein the power indicator is illuminated in response to the position sensor detecting the body is in the generally vertical orientation, wherein the power indicator is not illuminated in response to the position sensor detecting the body is in the generally horizontal orientation.

10. A reflex sight aiming device comprising:

a body having a front, a rear and opposing sides, the rear configured to face toward a user during use of the reflex sight aiming device to aim at a target, the body including a longitudinal axis;

a frame joined with a forward portion of the body, the frame extending upward from the body adjacent the front of the body, the frame including an arm extending toward a roof;

an illumination device housed in the body;

an optical element joined with the frame adjacent the front of the body, the roof extending over the optical element distal from the rear of the body;

a power indicator located distal from the optical element and the rear of the body, the power indicator disposed on at least one of the arm and the roof, wherein the illumination device is operable to display a dot on the optical element such that the dot is visible to a user along a first line of viewing from a rear of the body, and within a first field of view, wherein the power indicator is operable to emit illumination along a second line of viewing that is offset from the first line of viewing, wherein the second line of viewing is out of the first field of view so that the emitted illumination along the second line of view is not viewable within the first field of view when the user is viewing the dot along the first line of viewing within the first field of view, wherein the power indicator is disposed in a bore having a bore longitudinal axis that is offset at an angle between 1° and 89°, inclusive, from the longitudinal axis of the body.

11. The reflex sight aiming device of claim 10, wherein the second line of viewing is offset from the first line of viewing such that the user cannot view the displayed illumination from the power indicator while the user is viewing the dot along the first line of viewing within the first field of view from the rear of the body.

12. The reflex sight aiming device of claim 10, wherein the power indicator includes an illumination element that emits a first illumination to indicate that the dot is displayed on the optical element.

13. The reflex sight aiming device of claim 12, wherein the first illumination is in a first visible wavelength range, wherein the dot is displayed on the optical element in a second visible wavelength range different from the first visible wavelength range.

14. The reflex sight aiming device of claim 13, wherein the optical element is a lens, wherein the dot is at least one of a circular shaped dot, a pattern, a reticle and a sight indicia, wherein the illumination element is disposed in an aperture defined by the body.

15. The reflex sight aiming device of claim 14, wherein the aperture is an elongated bore having a bore longitudinal axis, wherein the bore longitudinal axis is angularly offset relative to a longitudinal axis of the body, wherein the second line of viewing is angularly offset from the first line of viewing.

16. The reflex sight aiming device of claim 10, wherein the optical element is transparent such that at user can view a target through the optical element while the dot is displayed on the optical element, wherein the first line of viewing lays in a horizontal plane, wherein the second line of viewing is transverse to the horizontal plane and to the first line of viewing.

17. The reflex sight aiming device of claim 10, wherein the power indicator is located on the upward extending frame.

18. The reflex sight aiming device of claim 17, wherein the upward extending frame includes a pair of upward extending arms that flank the optical element, wherein the power indicator is located on at least one of the upward extending arms.

19. The reflex sight aiming device of claim 17, wherein the upward extending frame includes a roof that extends over the optical element, wherein the power indicator is located on the roof.

20. A reflex sight aiming device comprising:

a body including a frame joined with a forward portion of the body, the body including a longitudinal axis, the frame extending upward from the body adjacent a front of the body that is distal from a rear of the body that faces a user;

an optical element joined with the body adjacent the front of the body and flanked by the upward extending frame to protect the optical element, the optical element having selectively displayed thereon a dot that is visible to the user along a first line of viewing and within a first field of view; and a power indicator located distal from the optical element and not displayed thereon, the power indicator operable to emit illumination along a second line of viewing that is offset from the first line of viewing, the power indicator configured to alert a user via the illumination emitted that the dot is displayed on the optical element without the user needing to directly view the dot along the first line of viewing, wherein the second line of viewing is out of the first field of view so that the emitted illumination along the second line of view is not viewable within the first field of view when the user is viewing the dot along the first line of viewing, wherein the power indicator is located on at least one of the upward extending frame and the front of the body, distal from the rear of the body, wherein the power indicator is disposed in a bore having a bore longitudinal axis that is offset at an angle between 1° and 89°, inclusive, from the longitudinal axis of the body.

* * * * *